US007012359B2

(12) United States Patent
Shimizu et al.

(10) Patent No.: US 7,012,359 B2
(45) Date of Patent: Mar. 14, 2006

(54) COLOR CATHODE-RAY TUBE

(75) Inventors: Norio Shimizu, Tokyo (JP); Toshio Uchikawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 10 days.

(21) Appl. No.: 10/909,317

(22) Filed: Aug. 3, 2004

(65) Prior Publication Data

US 2005/0007007 A1 Jan. 13, 2005

Related U.S. Application Data

(63) Continuation of application No. PCT/JP03/15308, filed on Dec. 1, 2003.

(30) Foreign Application Priority Data

Dec. 3, 2002 (JP) ..... 2002-351331

(51) Int. Cl.
*H01J 29/07* (2006.01)
*H01J 29/86* (2006.01)

(52) U.S. Cl. ..... 313/408; 313/402; 313/477 R

(58) Field of Classification Search ..... 313/477 R, 313/461, 422, 402, 408, 300
See application file for complete search history.

(56) References Cited

U.S. PATENT DOCUMENTS 6,333,594 B1 * 12/2001 Nakagawa et al. ..... 313/461
6,388,402 B1 * 5/2002 De Jong et al. ..... 315/368.28
6,407,494 B1 * 6/2002 Maehara et al. ..... 313/461
6,628,060 B1 * 9/2003 Shimizu et al. ..... 313/408
6,690,106 B1 * 2/2004 Yoshida et al. ..... 313/461
2002/0195920 A1 * 12/2002 Furusawa et al. ..... 313/402
2004/0239232 A1 * 12/2004 Baek et al. ..... 313/477 R
2004/0263046 A1 * 12/2004 Jeong ..... 313/402

FOREIGN PATENT DOCUMENTS

EP 655762 A1 10/1994
JP 11-242940 9/1999
JP 11-288676 10/1999
JP 2001060443 A * 3/2001
JP 2002-42698 A 2/2002
JP 2002-216672 A 8/2002
JP 2002260559 A * 9/2002

* cited by examiner

*Primary Examiner*—Ashok Patel
(74) *Attorney, Agent, or Firm*—Oblon, Spivak, McClelland, Maier & Neustadt

(57) ABSTRACT

The mask body satisfies the following conditions, $(Z_{MD}-Z_{MH})/L_{MS} \geqq 0.020$, and $0.065 \leqq Z_{MD}/L_{MD} \leqq 0.095$ where in a substantially rectangular effective region with a predetermined curvature of the mask body, $L_{MD}$ is a distance between a central part and a diagonal-axis end of the effective region, $L_{MS}$ is a distance between a horizontal-axis end and the diagonal-axis end of the effective region, $Z_{MD}$ is a height difference between the central part and the diagonal-axis end in a direction of the tube axis, and $Z_{MH}$ is a height difference between the central part and the horizontal-axis end in the direction of the tube axis. With this structure, the mechanical strength of the mask body can be improved, and deformation of the mask body in a fabrication process and due to external shock can be prevented.

5 Claims, 7 Drawing Sheets

COLOR CATHODE-RAY TUBE

CROSS-REFERENCE TO RELATED APPLICATIONS

This is a Continuation Application of PCT Application No. PCT/JP03/15308, filed Dec. 1, 2003, which was not published under PCT Article 21(2) in English.

This application is based upon and claims the benefit of priority from prior Japanese Patent Application No. 2002-351331, filed Dec. 3, 2002, the entire contents of which are incorporated herein by reference.

BACKGROUND OF THE INVENTION

1. Field of the Invention

The present invention relates to a color cathode-ray tube, and more particularly to a color cathode-ray tube with an enhanced visibility, wherein the mechanical strength of the mask body is improved.

2. Description of the Related Art

In general, in a color cathode-ray tube, three electron beams that are emitted from an electron gun assembly are deflected in a horizontal direction and a vertical direction, while they are being converged. Thereby, a color image is displayed. A deflection coil that generates deflection magnetic fields for deflecting the electron beams comprises at least a pair of horizontal coils and a pair of vertical coils. The convergence characteristics of the three electron beams are substantially determined by the deflection magnetic fields that are generated by the deflection yoke. Thus, as is generally known, the horizontal deflection magnetic field is formed of a pincushion type magnetic field and the vertical deflection magnetic field is formed of a barrel type magnetic field.

In actual cases, in order to correct coma aberration, etc., the horizontal deflection field has a barrel shape on an electron gun-side part thereof and a pincushion shape on a phosphor screen-side part thereof, and thus the horizontal deflection field is formed in a pincushion shape as a whole. In addition, the vertical deflection field has a pincushion shape on an electron gun-side part thereof and a barrel shape on a phosphor screen-side part thereof, and thus the vertical deflection field is formed in a barrel shape as a whole.

In this case, since the vertical deflection field has a barrel shape as a whole, pincushion-type image distortion occurs in the vicinity of a horizontal-axis end part on the screen, that is, in the vicinity of a minor-axis side part. In a case where the degree of pincushion-type distortion is great due to an influence of flattening of the screen, etc., a deflection current waveform is corrected in usual cases, thereby correcting the pincushion-type distortion.

In this color cathode-ray tube, in order to display a color image, which is free from color misregistration, on the phosphor screen, it is necessary that the three electron beams, which have passed through electron beam passage holes formed in a mask body of the shadow mask, correctly land on the associated three-color phosphor layers on the phosphor screen. To achieve this, the shadow mask needs to be exactly disposed at a predetermined position relative to the panel. In short, a distance (q-value) between the panel and shadow mask needs to be exactly and properly set.

In recent years, in order to enhance the visibility of color cathode-ray tubes, there is a demand for a decrease in curvature (i.e. an increase in radius of curvature) of the outer surface of the panel to a level of a flat plane. Accordingly, it becomes necessary to similarly decrease the curvature of the inner surface of the panel from the standpoint of visibility. Further, in order to cause the electron beams to exactly land on the phosphor layers on the inner surface of the panel, it is necessary to properly set the q-value, as mentioned above. Moreover, the curvature of the mask body having electron beam passage holes needs to be decreased in accordance with the inner surface of the panel (see, e.g. Jpn. Pat. Application. KOKAI Publications Nos. 11-242940 and 11-288676).

If the curvature of the mask body is set at a small value, however, the mechanical strength of the shadow mask itself would decrease. Consequently, in the fabrication process of the cathode-ray tube, deformation of the shadow mask, for instance, would occur. Such deformation of the mask body leads to displacement of beam landing. If the electron beam shifts beyond a black non-emission layer due to the displacement of beam landing and the beam causes a phosphor layer, which is other than the phosphor layer of the color associated with this beam, to emit light, considerable degradation would occur in color purity.

In the case where the curvature of the inner surface of the panel is set at a large value in accordance with the curvature of the mask body, the fabrication of the panel becomes difficult and degradation in visibility, such as a decrease in luminance at the peripheral part of the panel, occurs. It is desirable, therefore, that the curvature of the inner surface of the panel be as small as possible.

With the flattening in panel shape, the aforementioned pincushion-type distortion near the horizontal-axis end of the screen increases. This problem cannot sufficiently be solved by the above-mentioned correction of the deflection current waveform. To solve this problem, there is a method wherein on the phosphor screen side of the deflection yoke, a magnetic member is employed to lead a leak magnetic field of the vertical deflection coil out toward the funnel side of the deflection yoke, and a pincushion-shaped magnetic field is produced in addition to a barrel-shaped vertical deflection magnetic field. Thereby, the pincushion-type distortion on the screen is corrected.

This method, however, cannot completely deal with the problem, and a permanent magnet for correction needs to be disposed on the phosphor screen side of the deflection yoke. In this case, if the mask body is designed to match with such deflection fields, the curved-surface strength of the mask body would considerably deteriorate.

As described above, if the curvature of the outer surface of the panel is decreased in order to enhance visibility and the pincushion-type distortion on the screen is corrected by the deflection yoke, the curvature of the inner surface of the panel is decreased and the curvature of the mask body is decreased. As a result, the mechanical strength of the mask body will decrease. Hence, the deformation of the mask body that occurs in the fabrication process and due to external shock leads to displacement in beam landing, and the color purity of the color cathode-ray tube considerably deteriorates.

In the case where the curvature of the inner surface of the panel, as well as the curvature of the mask body, is set at a large value in order to solve the above problem, the luminance at the peripheral part of the panel cannot be made uniform and the flatness may be lost. In some cases, it is difficult to completely correct-a distortion on the screen.

BRIEF SUMMARY OF THE INVENTION

The present invention has been made to solve the above problems, and the object of the invention is to provide a color cathode-ray tube with good visibility, which can have uniform luminance over the entire screen and can display high-quality images with less distortion.

According to a first aspect of the invention, there is provided a color cathode-ray tube comprising:

an envelope including a substantially rectangular panel with a substantially flat outer surface, and a funnel coupled to the panel;

a phosphor screen that is formed on an inner surface of the panel;

an electron gun assembly that is disposed within the envelope and emits an electron beam toward the phosphor screen;

a shadow mask including a mask body that is disposed to face the phosphor screen and has a number of electron beam passage holes, and a mask frame that supports a peripheral part of the mask body; and a deflection yoke that generates a deflection magnetic field for deflecting the electron beam emitted from the electron gun assembly, wherein the envelope has a tube axis that passes through a central part of the panel and a center of the electron gun assembly, a horizontal axis that intersects at right angles with the tube axis, and a vertical axis that intersects at right angles with the tube axis and the horizontal axis, at least a pair of magnets are disposed on a horizontal axis of that part of the deflection yoke, which is located on the phosphor screen side, and the mask body satisfies the following conditions, $$(Z_{MD}-Z_{MH})/L_{MS} \geqq 0.020, \text{ and}$$

$$0.065 \leqq Z_{MD}/L_{MD} \leqq 0.095$$

where in a substantially rectangular effective region with a predetermined curvature of the mask body, $L_{MD}$ is a distance between a central part and a diagonal-axis end of the effective region, $L_{MS}$ is a distance between a horizontal-axis end and the diagonal-axis end of the effective region, $Z_{MD}$ is a height difference between the central part and the diagonal-axis end in a direction of the tube axis, and $Z_{MH}$ is a height difference between the central part and the horizontal-axis end in the direction of the tube axis.

According to a second aspect of the invention, there is provided a color cathode-ray tube comprising:

an envelope including a panel with a substantially flat outer surface and a substantially rectangular effective portion, and a funnel coupled to the panel;

a phosphor screen that is formed on an inner surface of the panel;

an electron gun assembly that is disposed within the envelope and emits an electron beam toward the phosphor screen;

a shadow mask including a mask body that is disposed to face the phosphor screen and has a number of electron beam passage holes, and a mask frame that supports a peripheral part of the mask body; and a deflection yoke that generates a deflection magnetic field for deflecting the electron beam emitted from the electron gun assembly, wherein the envelope has a tube axis that passes through a central part of the panel and a center of the electron gun assembly, a horizontal axis that intersects at right angles with the tube axis, and a vertical axis that intersects at right angles with the tube axis and the horizontal axis, at least a pair of magnets are disposed on a horizontal axis of that part of the deflection yoke, which is located on the phosphor screen side, and the effective portion of the panel satisfies the following conditions, $$(Z_{PD}-Z_{PH})/L_{PS} \geqq 0.030, \text{ and}$$

$$0.045 \leqq Z_{PD}/L_{PD} \leqq 0.075$$

where in a substantially rectangular inner surface with a predetermined curvature of the effective portion of the panel, $L_{PD}$ is a distance between a central part and a diagonal-axis end of the inner surface of the effective portion, $L_{PS}$ is a distance between a horizontal-axis end and the diagonal-axis end of the inner surface of the effective portion, $Z_{PD}$ is a height difference between the central part and the diagonal-axis end in a direction of the tube axis, and $Z_{PH}$ is a height difference between the central part and the horizontal-axis end in the direction of the tube axis.

According to the color cathode-ray tube with the above structure, an image distortion on the screen can completely be corrected by the magnetic field that is generated by the magnet disposed on the deflection yoke. In addition, since the curvature of the mask body is set at a proper condition, the mechanical strength of the mask body can be improved, and deformation of the mask body in the fabrication process and due to external shock can be prevented. Thereby, displacement in beam landing due to deformation of the mask body can be prevented, and deterioration in color purity due to displacement in beam landing can be suppressed.

Furthermore, while distortion-free images can be displayed, the curvatures of the mask body and the inner surface of the panel are set at proper conditions. Thus, uniform luminance can be obtained over the entire screen, and the visibility can be enhanced. Besides, degradation in flatness is prevented, and the visibility is enhanced.

DETAILED DESCRIPTION OF THE INVENTION

An embodiment of a color cathode-ray tube according to the present invention will now be described in detail with reference to the accompanying drawings.

Figure 1:
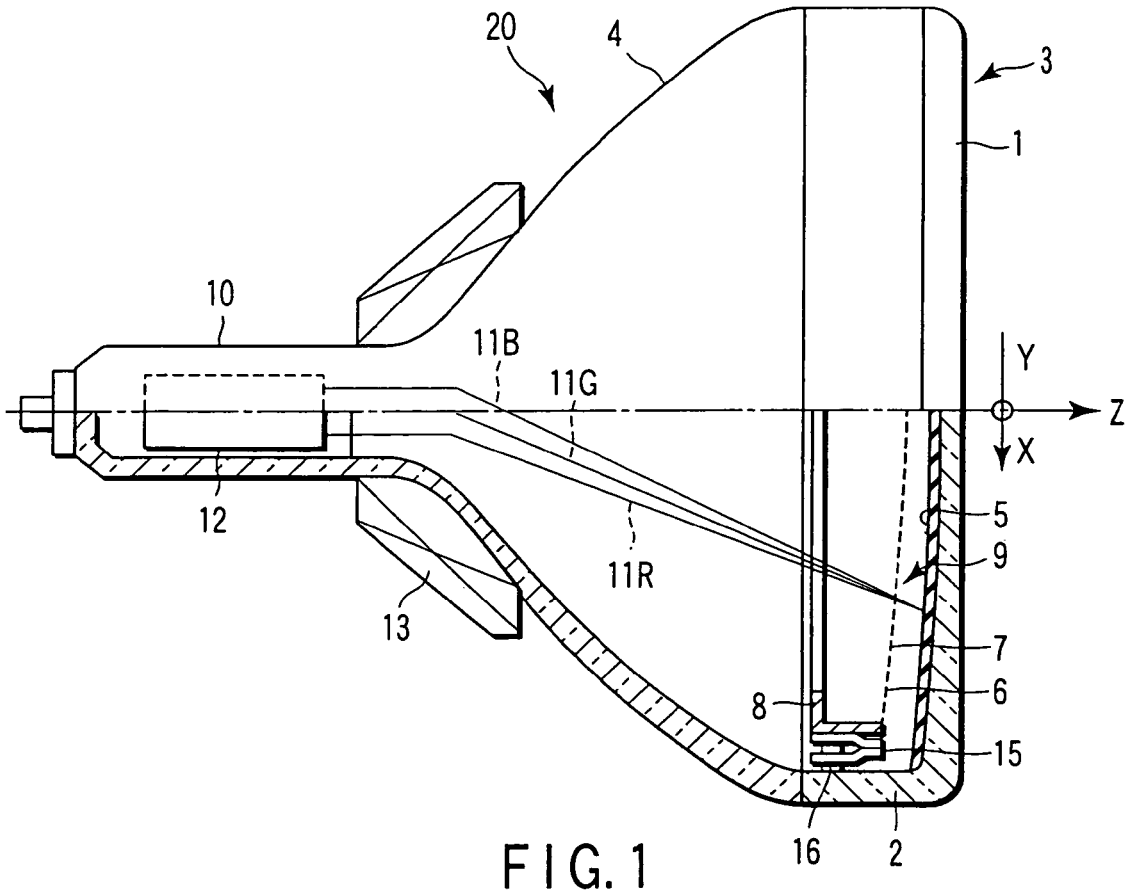
FIG. 1 schematically shows the structure of a color cathode-ray tube according to an embodiment of the present invention.

As is shown in FIG. 1, the color cathode-ray tube includes a vacuum envelope 20. The vacuum envelope 20 includes a panel 3 and a funnel 4. The panel 3 includes a substantially rectangular effective portion 1 and a skirt portion 2 that extends upright from a peripheral part of the effective portion 1. The funnel 4 is coupled to the skirt portion 2. An axis extending through the central part of the effective portion 1 and an electron gun assembly 12 is defined as a tube axis Z. An axis intersecting at right angles with the tube axis Z is defined as a major axis (horizontal axis) X, and an axis intersecting at right angles with the tube axis and major axis X is defined as a minor axis (vertical axis) Y.

Figure 2:
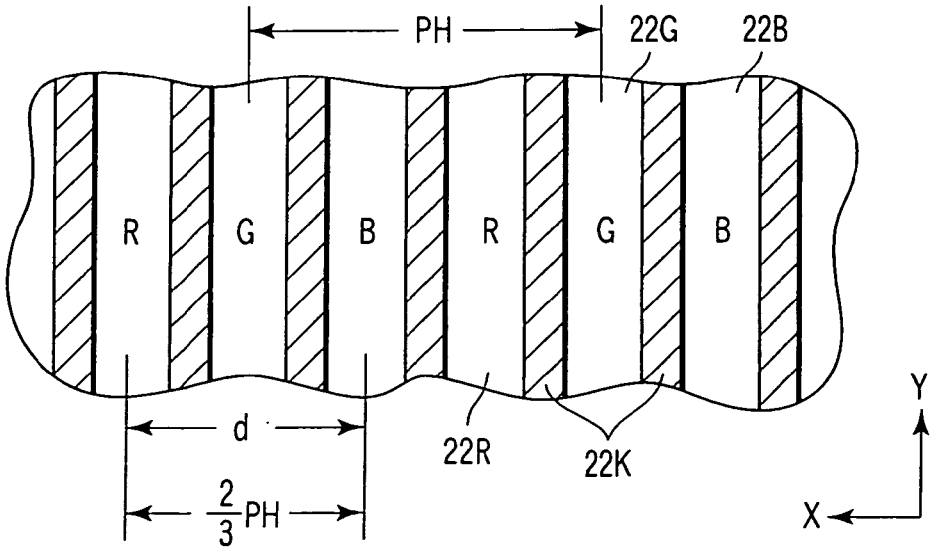
FIG. 2 is a plan view that schematically shows the structure of a phosphor screen of the color cathode-ray tube shown in FIG. 1.

The outer surface of the effective portion 1 of the panel 3 is formed substantially flat. A phosphor screen 5 is provided on the inner surface of the effective portion 1 of panel 3. As is shown in FIG. 2, the phosphor screen 5 includes striped three-color phosphor layers 22 (R, G, B), which emit red (R), green (G) and blue (B) light and extend in parallel with the minor axis Y, and striped black non-emission layers 22K, which are provided between the phosphor layers 22 (R, G, B).

The three-color phosphor layers 22 (R, G, B) are equidistantly arranged along the major axis X in a predetermined order of, e.g. red (R), green (G), blue (B), red (R), green (G), red (R), . . . . In a case where a distance between same-color phosphor layers (distance between green phosphor layers 22G in FIG. 2) is PH, a distance d between two of the three phosphor layers (distance between the centers of red phosphor layer 22R and blue phosphor layer 22B in FIG. 2) is set to be d=(⅔)PH.

Figure 3:
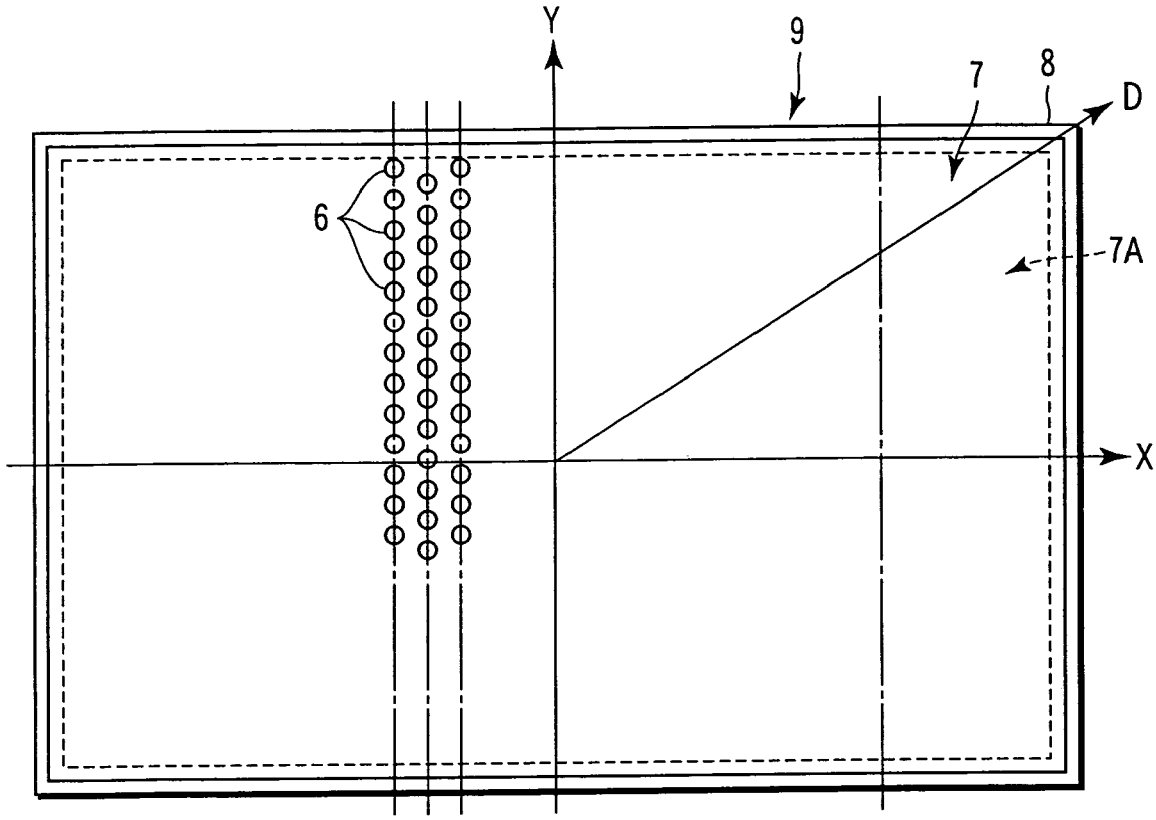
FIG. 3 is a plan view that schematically shows the structure of a shadow mask in the color cathode-ray tube shown in FIG. 1.

As is shown in FIGS. 1 and 3, a shadow mask 9 is disposed to face the phosphor screen 5 within the vacuum envelope 20. The shadow mask 9 includes a mask body 7, which is disposed to face the phosphor screen 5, and a rectangular mask frame 8 with an L-shaped cross section, which supports a peripheral part of the mask body 7. The mask body 7 includes a substantially rectangular effective region 7A that is formed of a curved surface with a number of electron beam passage holes 6.

The shadow mask 9 is detachably supported on the panel. Specifically, elastic support members 15, which are attached to side surfaces of corner portions of the mask frame 8 or to side surfaces of side portions of the mask frame 8, are engaged with stud pins 16, which are provided on corner portions or side portions of the inner surface of the skirt portion 2 of panel 3.

The in-line electron gun assembly 12 is disposed within a cylindrical neck 10 that corresponds to a small-diameter part of the funnel 4. The electron gun assembly 12 emits three electron beams 11 (R, G, B), which are arranged in line in the same plane, toward the phosphor screen 5.

Figure 4:
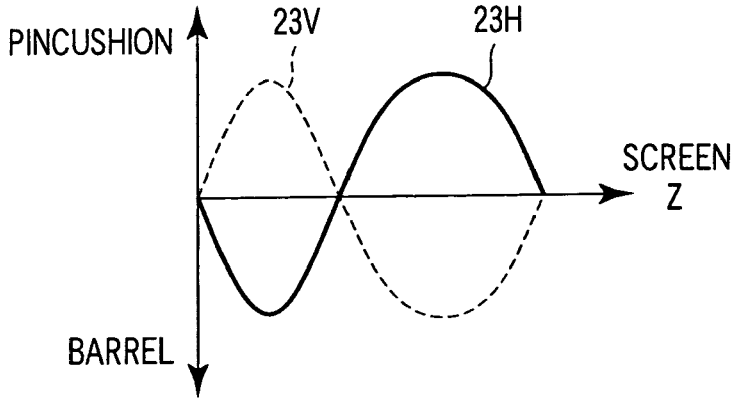
FIG. 4 shows a horizontal deflection field and a vertical deflection field that are generated by a deflection yoke in the color cathode-ray tube shown in FIG. 1.

A deflection yoke 13 is attached to the outer surface of the funnel 4. The deflection yoke 13 generates non-uniform deflection magnetic fields that deflect the three electron beams 11 (R, G, B), which are emitted from the electron gun assembly 12, in the direction of horizontal axis X and the direction of vertical axis Y. The non-uniform deflection magnetic fields comprise a horizontal deflection field and a vertical deflection field. Specifically, as shown in FIG. 4, a horizontal deflection field 23H has a barrel shape on the electron gun assembly side and a pincushion shape on the phosphor screen side, and the horizontal deflection field 23H is formed in a pincushion shape as a whole. A vertical deflection field 23V has a pincushion shape on the electron gun assembly side and a barrel shape on the phosphor screen side, and the vertical deflection field 23V is formed in a barrel shape as a whole.

In the color cathode-ray tube with the above-described structure, the three electron beams 11 (R, G, B) that are emitted from the electron gun assembly 12 are focused on the associated phosphor layers, while they are being self-converged toward the phosphor screen 5. The three electron beams 11 (R, G, B) are deflected by the non-uniform deflection magnetic fields that are generated by the deflection yoke 13, and are horizontally and vertically scanned over the phosphor screen 5 via the electron beam passage holes 6 that are formed in the shadow mask 9. Thus, a color image is displayed.

In this case, in order to display an image, which is free from color misregistration, on the phosphor screen 5 of the color cathode-ray tube, it is necessary that the electron beams, which pass through the electron beam passage holes 6 in the mask body 7, land exactly on the three-color phosphor layers of the phosphor screen 5. To achieve this, the positional relationship between the panel 3 and shadow mask 9 needs to be exactly maintained.

In addition, in order to enhance the visibility of the color cathode-ray tube, the outer surface of the panel 3 is, in usual cases, formed in a substantially flat shape (with a radius of curvature of about 10 m, preferably infinite). Accordingly, the curvature of the mask body 7 needs to be decreased. If the curvature of the mask body 7 is decreased, however, the mechanical strength of the mask body 7 would decrease.

Figure 5:
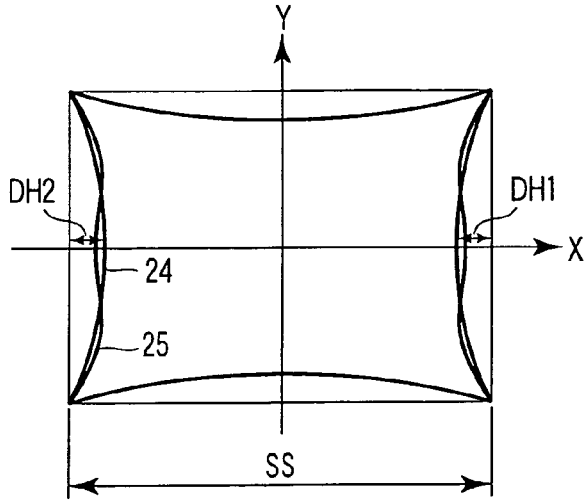
FIG. 5 is a view for explaining a pincushion-type distortion that occurs on the screen of the color cathode-ray tube.

To solve this problem, it can be thought to increase the curvature of the mask body 7 and to increase the curvature of the inner surface of the panel 3 as much as possible. In this case, however, there arises a problem with the fabrication of the panel 3, and the flatness is lost. Moreover, with flattening of the panel, a great image distortion occurs on the display screen, and a large pincushion-type distortion 24 occurs, as shown in FIG. 5, for example.

Under the circumstances, the color cathode-ray tube according to the present embodiment is configured as described below. Assume that the color cathode-ray tube has design specifications: the diagonal effective dimension of the effective portion 1 is 51 cm, the aspect ratio is 4:3, and the radius of curvature of the outer surface of the panel is 50,000 mm.

Figure 6A:
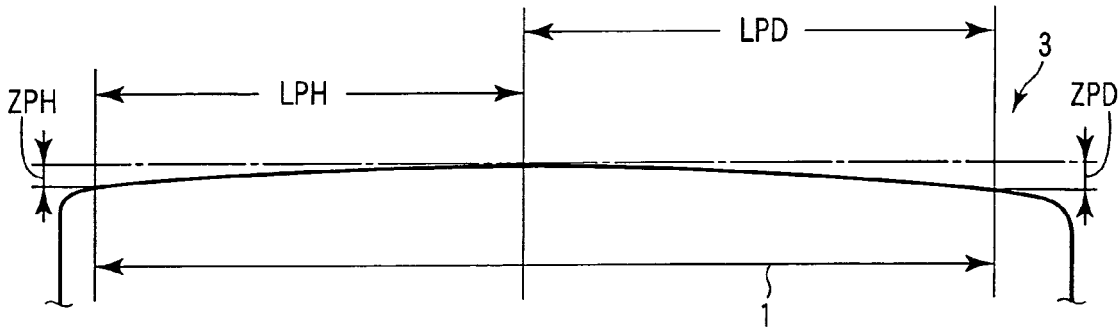
FIG. 6A schematically shows a cross-sectional shape of an effective portion of the panel.
Figure 6B:
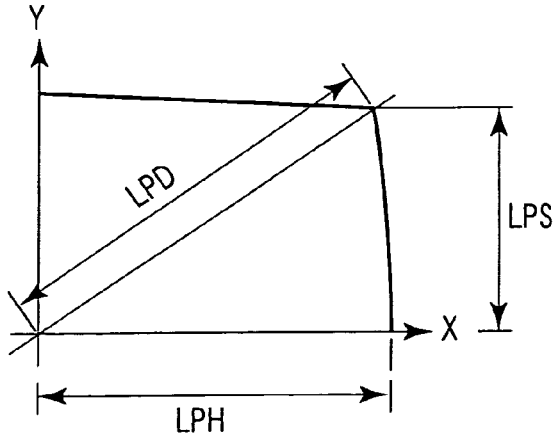
FIG. 6B schematically shows a plan-view shape of the effective portion of the panel.

FIG. 6A schematically shows a cross-sectional shape of the inner surface of the effective portion of the panel. FIG. 6B schematically shows a plan-view shape of the inner surface of the effective portion of the panel. A distance between a central part and a diagonal-axis end of the effective portion 1 is defined as $L_{PD}$. A distance between the central part and a horizontal-axis end is defined as $L_{PH}$. A distance between the horizontal-axis end and the diagonal-axis end is defined as $L_{PS}$. A height difference (depression amount) between the central part and the diagonal-axis end in the direction of the tube axis Z is defined as $Z_{PD}$. A height difference (depression amount) between the central part and the horizontal-axis end in the direction of the tube axis Z is defined as $Z_{PH}$. In the example shown in FIGS. 6A and 6B, the following equations are established:

$$(Z_{PD}-Z_{PH})/L_{PS}=0.050, \text{ and } Z_{PD}/L_{PD}=0.055.$$

Figure 7A:
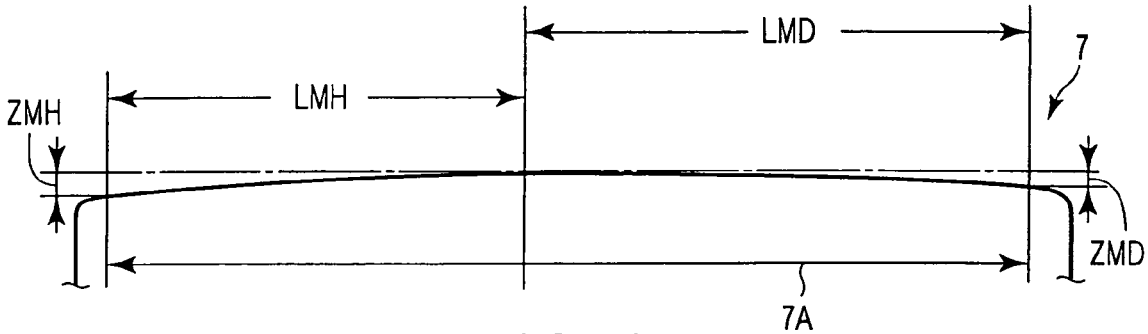
FIG. 7A schematically shows a cross-sectional shape of an effective region of a mask body.
Figure 7B:
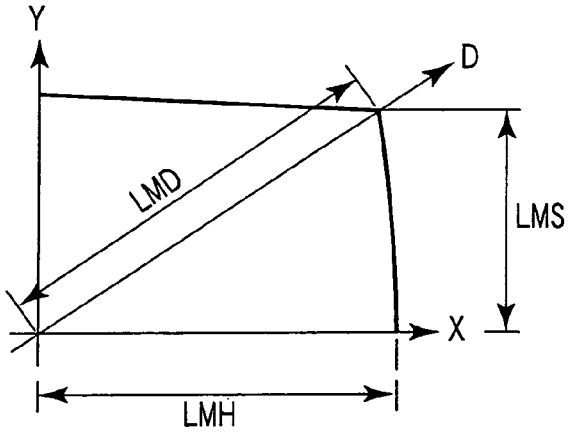
FIG. 7B schematically shows a plan-view shape of the effective region.

On the other hand, FIG. 7A schematically shows a cross-sectional shape of an effective region of the mask body. FIG. 7B schematically shows a plan-view shape of the effective region of the mask body. A distance between a central part and a diagonal-axis end of an effective region 7A is defined as $L_{MD}$. A distance between the central part and a horizontal-axis end is defined as $L_{MH}$. A distance between the horizontal-axis end and the diagonal-axis end is defined as $L_{MS}$. A height difference (depression amount) between the central part and the diagonal-axis end in the direction of the tube axis Z is defined as $Z_{MD}$. A height difference (depression amount) between the central part and the horizontal-axis end in the direction of the tube axis Z is defined as $Z_{MH}$. In the example shown in FIGS. 7A and 7B, the following equations are established:

$$(Z_{MD}-Z_{MH})/L_{MS}=0.028, \text{ and } Z_{MD}/L_{MD}=0.077.$$

Figure 8:
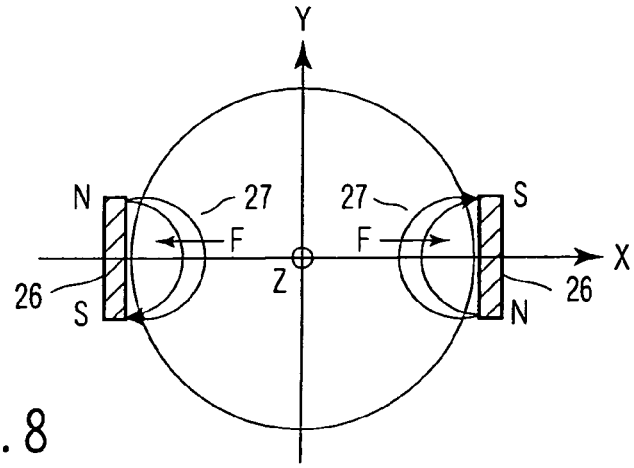
FIG. 8 is a view for explaining correction fields for correcting the pincushion-type distortion illustrated in FIG. 5.

In the color cathode-ray tube according to the present embodiment, the deflection yoke 13, as shown in FIG. 8, includes at least a pair of permanent magnets 26 that are disposed on the horizontal axis X at the phosphor screen-side end of the deflection yoke 13. The permanent magnets 26 generate correction magnetic fields 27 for correcting the pincushion-type distortion 24 that occurs mainly in the vicinity of the right and left parts (horizontal-axis end parts) on the screen. Thereby, even if the panel shape is flattened, the pincushion-type distortion on the screen can be corrected, and the display quality enhanced.

Figure 9:
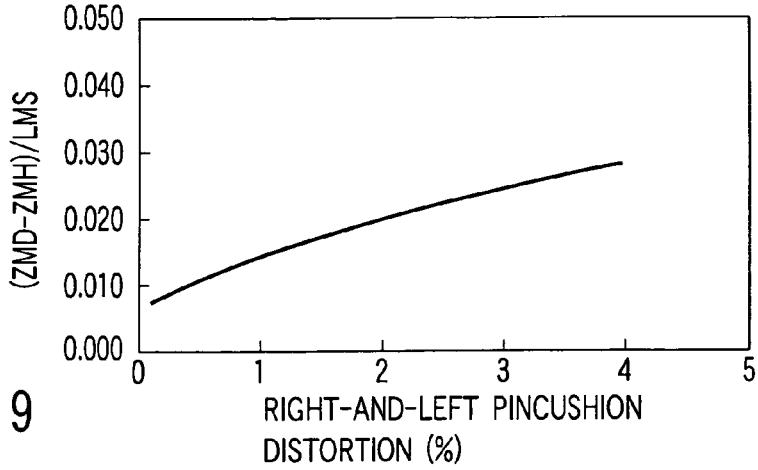
FIG. 9 is a graph showing a relationship between the amount of pincushion-type distortion and a $(Z_{MD}-Z_{MH})/L_{MS}$ value of the mask body, which is set in consideration of correction fields.

FIG. 9 is a graph showing a relationship between the amount of pincushion-type distortion (the ratio of a distortion dimension (DH1+DH2) to an effective dimension (SS) on the horizontal axis in FIG. 5) and a $(Z_{MD}-Z_{MH})/L_{MS}$ value of the mask body 7, which is set in consideration of correction fields. In short, the $(Z_{MD}-Z_{MH})/L_{MS}$ value tends to decrease by the correction of the pincushion-type distortion.

Figure 10A:
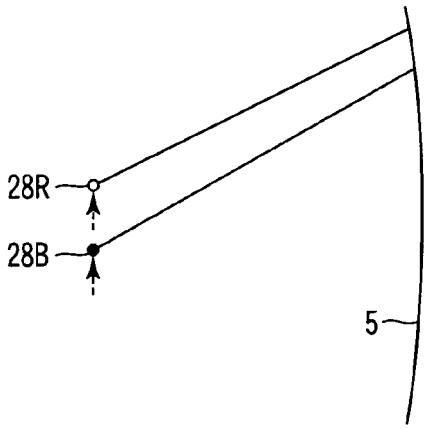
FIG. 10A is a view for explaining degradation in convergence characteristics.
Figure 10B:
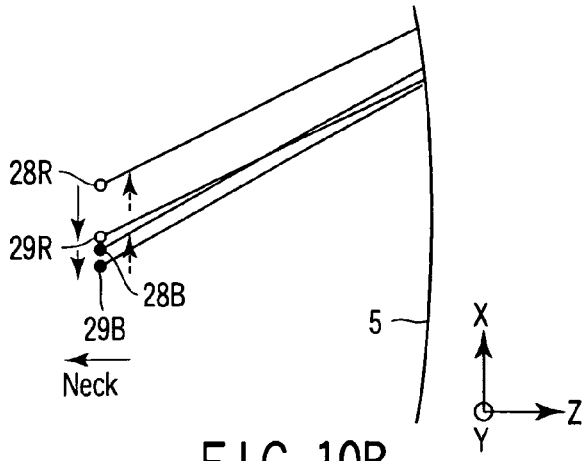
FIG. 10B is a view for explaining compensation of convergence characteristics.
Figure 11A:
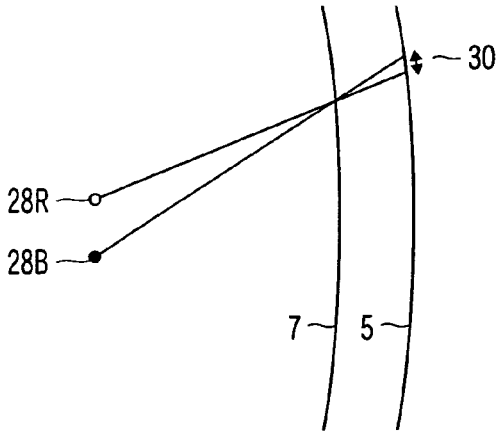
FIG. 11A is a view for explaining trajectories of electron beams prior to compensation of convergence characteristics.
Figure 11B:
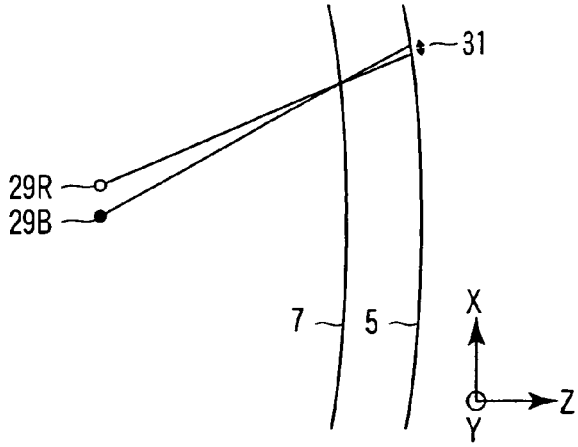
FIG. 11B is a view for explaining trajectories of electron beams after compensation of convergence characteristics.

The reason for this is as follows. As is illustrated in a schematic view of FIG. 10A, the convergence characteristics are degraded by the disposition of the permanent magnets 26 on the phosphor screen side of the deflection yoke 13. In order to compensate the convergence characteristics, the electron gun assembly-side barrel field that forms the horizontal deflection magnetic field is intensified, as shown in FIG. 10B. Thereby, electron beam trajectories 28R and 28B are corrected in the direction of arrows on the rear side (neck side). Corrected electron beam trajectories are illustrated as 29R and 29B. As result, as shown in FIGS. 11A and 11B, as regards the trajectories of the electron beams that pass through the electron beam passage holes in the mask body 7, a distance 30 between the read the blue side beams decreases, as indicated by numeral 31. This phenomenon is conspicuous on the horizontal axis, where the effect of the permanent magnets is greatest. The decrease in distance between the side beams on the phosphor screen 5 needs to be corrected by the q-value. If the q-value is corrected by the shadow mask 9, the $(Z_{MD}-Z_{MH})/L_{MS}$ value of the mask body 7 varies, as shown in FIG. 9.

Figure 12:
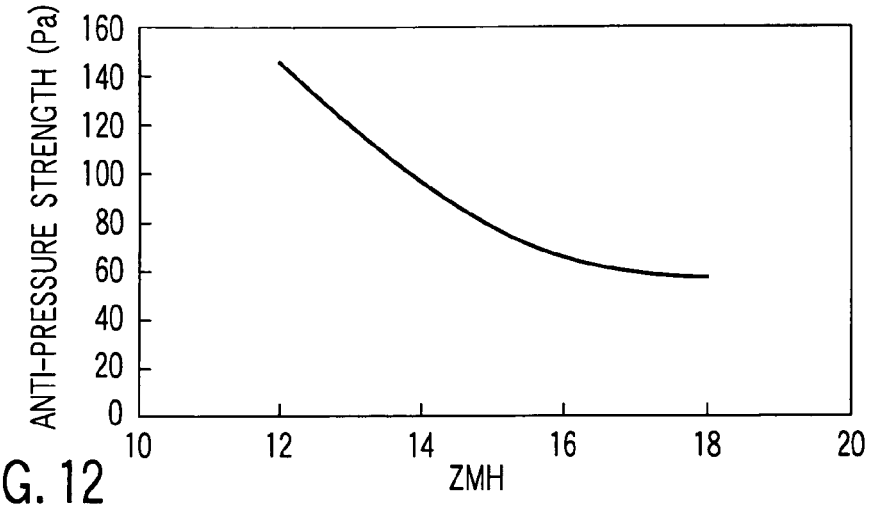
FIG. 12 is a graph showing a relationship between a depression amount ZMH and an anti-pressure strength of the mask body.

Next, an explanation is given of the relationship between the depression amount $Z_{MH}$ and the anti-pressure strength to buckling deformation of the mask body in the case where the depression amount $Z_{MD}$ is set to be constant. FIG. 12 shows the relationship between the depression amount $Z_{MH}$ and the anti-pressure strength of the mask body. In normal cases, if the depression amount increases, the roundness of the mask body 7 increases and accordingly the anti-pressure strength increases. In the example of FIG. 12, however, the anti-pressure strength decreases as the depression amount $Z_{MH}$ increases.

Figure 13:
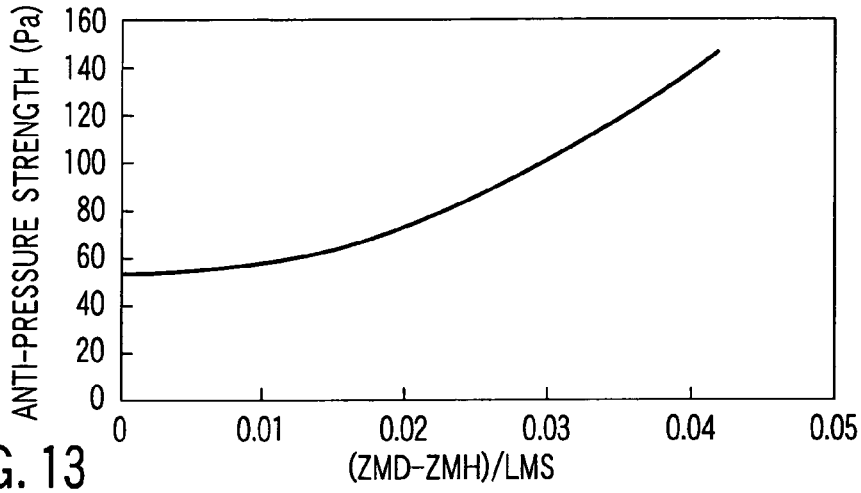
FIG. 13 is a graph showing a relationship between a $(Z_{MD}-Z_{MH})/L_{MS}$ value and an anti-pressure strength of the mask body.

That the depression amount ZMH increases when the depression amount ZMD is set to be constant means that the $(Z_{MD}-Z_{MH})/L_{MS}$ value decreases. Specifically, as shown in FIG. 13, as the $(Z_{MD}-Z_{MH})/L_{MS}$ value decreases, the anti-pressure strength to buckling deformation of the mask body deteriorates. In other words, if the depression amount $Z_{MH}$ at the horizontal-axis end increases, there is little difference from the depression amount $Z_{MD}$ at the diagonal-axis end.

This means that the curvature in the vertical-axis direction in the range from the horizontal-axis end to the diagonal-axis end decreases and the degree of flatness increases. To be more specific, it may be considered that as the depression amount $Z_{MH}$ at the horizontal-axis end increases, the curvature on the horizontal axis increases and the anti-pressure strength would be improved. In the present case, however, the curvature near the minor-axis side part of the shadow mask body 7 in the region between the horizontal-axis end and the diagonal-axis end decreases, and thus the anti-pressure strength as a whole deteriorates.

Consequently, as has been described with reference to FIG. 9, if the $(Z_{MD}-Z_{MH})/L_{MS}$ value is decreased in accordance with the correction of the pincushion-type distortion, the anti-pressure strength of the mask body 7 lowers. Although it is desirable to decrease the $(Z_{MD}-Z_{MH})/L_{MS}$ value in accordance with the correction of pincushion-type distortion, the $(Z_{MD}-Z_{MH})/L_{MS}$ value needs to be 0.020 or more in order to secure the anti-pressure strength of 70 Pa that is a general reference value. In short, as regards the effective region 7A of the mask body 7, the formula, $$(Z_{MD}-Z_{MH})/L_{MS}\geqq 0.020$$

is established, and this makes it possible to correct the pincushion-type distortion and to secure a sufficient anti-pressure strength.

However, in order to correct the pincushion-type distortion and to secure the anti-pressure strength at the same time, it is desirable to provide a panel 3 having the inner surface shape that corresponds to the mask body 7 used in the example of FIG. 9. Specifically, as described with reference to FIG. 2, in usual cases, the q-value is determined so that the distance d on the phosphor screen 5 may become a proper value, i.e. ⅔PH. In this case, in the effective portion 1 of the panel 3, a variation in distance d, relative to the q-value at the diagonal-axis end, is about 1.20 to 1.35 times as large as a variation at the horizontal-axis end. In other words, at the horizontal-axis end, the q-value is set at a large value. In this case, in order to set the $(Z_{MD}-Z_{MH})/L_{MS}$ value of the mask body 7 at 0.020 or more, a value of 0.030 or more is required for the panel. In short, as regards the effective portion 1 of the panel 3, the formula, $$(Z_{PD}-Z_{PH})/L_{PS} \geqq 0.030$$

is established, and this makes it possible to correct the pincushion-type distortion and to secure a sufficient anti-pressure strength.

Figure 14:
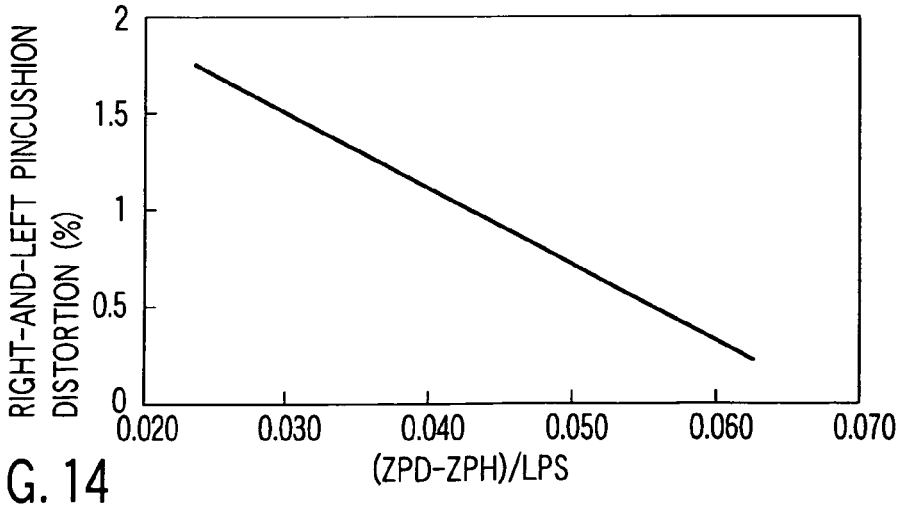
FIG. 14 is a graph showing a relationship between a $(Z_{PD}-Z_{PH})/L_{PS}$ value and a pincushion-type distortion near a minor-axis side part.

As is shown in FIG. 14, in consideration of a relationship between the $(Z_{PD}-Z_{PH})/L_{PS}$ value and the pincushion-type distortion near the minor-axis side part, it is understood that the value of 0.030 or more is preferable.

Figure 15:
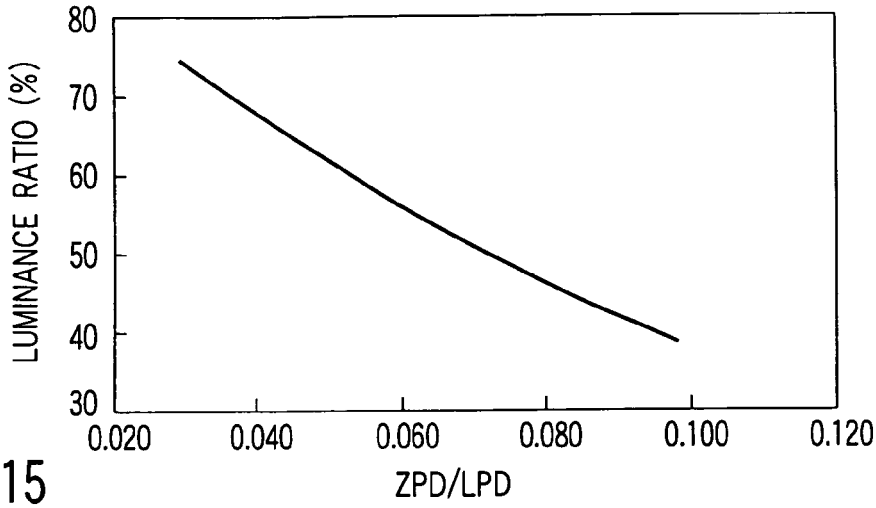
FIG. 15 is a graph showing a relationship between a $Z_{PD}/L_{PD}$ value and the ratio of a diagonal-axis-end luminance to a central-part luminance.

In addition, in this case, there is such a danger that a considerable deterioration may occur in luminance at the peripheral part of the panel 3, relative to the central part of the panel 3. It is thus necessary to properly set the luminance. FIG. 15 is a graph showing a relationship between a $Z_{PD}/L_{PD}$ value and the ratio of a diagonal-axis-end luminance to a central-part luminance. It is generally considered that the luminance ratio should preferably be 50% or more in terms of visibility. From the result shown in FIG. 15, it is desirable that the $Z_{PD}/L_{PD}$ value be set at 0.075 or less.

The luminance ratio shown in FIG. 15 is affected by the transmittance of glass, of which the panel 3 is formed. It is desirable that the light transmittance of the central part of the effective portion 1 at a wavelength of 546 nm be 45% to 55%. Although a higher transmittance is tolerable, the contrast will deteriorate. Thus, if the same characteristics are to be obtained, a high-cost member such as an optical film has to be used.

On the other hand, in consideration of the resolution in this case, the interval of rows of electron beam passage holes in the diagonal-axis end of the mask body needs to be set at about 1.35 times as large as that in the central part of the mask body. In addition, in consideration of a variation in distance d relative to the q-value, the q-value needs to be greater at the diagonal-axis end than at the central part, in order to keep the distance d at a proper value and to make uniform the interval of stripes of the phosphor screen 5. To satisfy the condition of this q-value, the $Z_{MD}/L_{MS}$ value needs to be set at 0.095 or less.

Figure 16:
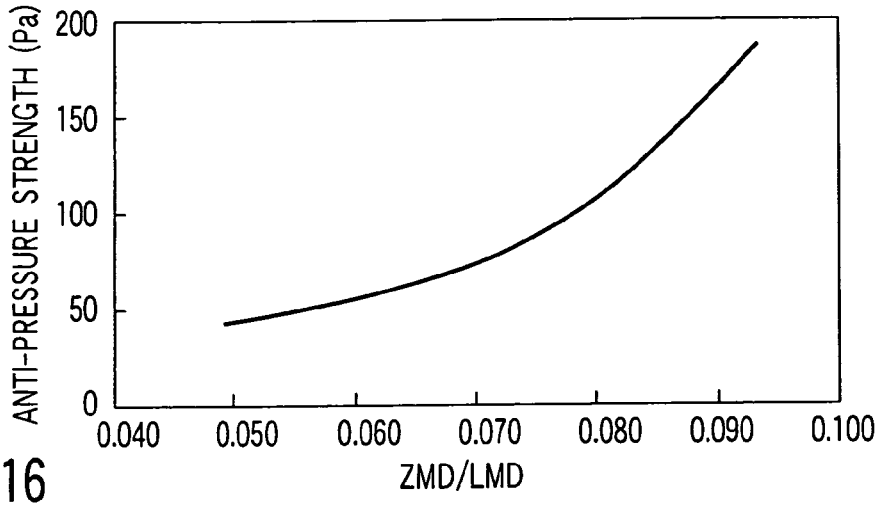
FIG. 16 is a graph showing a relationship between a $Z_{MD}/L_{MD}$ value and an anti-pressure strength.

On the other hand, taking into account the anti-pressure strength to buckling deformation of the mask body 7, the relationship between the $Z_{MD}/L_{MD}$ value and the anti-pressure strength is determined, as shown in FIG. 16, when the $(Z_{MD}-Z_{MH})$ value is set to be constant. Specifically, in order to secure the anti-pressure strength of 70 Pa or more, the $Z_{MD}/L_{MD}$ value is set at 0.065 or more. In short, as regards the mask body 7, the formula, $$0.065 \leqq Z_{MD}/L_{MD} \leqq 0.095$$

is established, and this makes it possible to secure a luminance ratio and an anti-pressure strength.

In this case, as regards the inner surface of the panel, as described above, if the interval of rows of electron beam passage holes at the diagonal-axis end of the mask body 7 is about 1.35 times as large as that at the central part thereof, the $Z_{PD}/L_{PD}$ value needs to be set at 0.045 or more in order to maintain the distance d at a proper value and to make uniform the interval of stripes. In short, as regards the panel 3, the formula, $$0.045 \leqq Z_{PD}/L_{PD} \leqq 0.075$$

is established, and this makes it possible to secure a luminance ratio and an anti-pressure strength.

As has been described above, the present embodiment provides a color cathode-ray tube wherein the shape of the inner surface of the panel 3 meets the relationships, $$(Z_{PD}-Z_{PH})/L_{PS}=0.050, \text{ and } Z_{PD}/L_{PD}=0.055, \text{ and}$$

the mask body 7 meets the relationships, $$(Z_{MD}-Z_{MH})/L_{MS}=0.028, \text{ and } Z_{MD}/L_{MD}=0.077.$$

According to this color cathode-ray tube, even where the outer surface of the panel is flattened to improve the visibility, it is possible to eliminate distortion of a display image and to prevent degradation in color purity, a decrease in peripheral luminance and deterioration in flatness. A high-quality image can be displayed.

Figure 17:
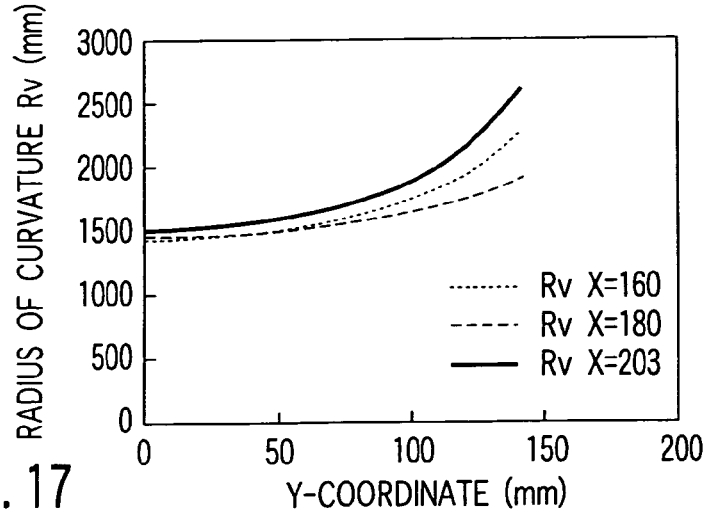
FIG. 17 is a graph showing a distribution of a radius of curvature Rv, relative to a Y-coordinate from the central part to the minor-axis end of the panel.

Next, the radius of curvature at the peripheral part of the inner surface of the panel is described. FIG. 17 is a graph showing a distribution of a radius of curvature, relative to a Y-coordinate from the central part to the minor-axis end of the panel 3. Assume that a panel peripheral part refers to a horizontal-axis-end-side part, as shown in FIG. 3, which corresponds to at least a ⅓ of the range between the central part of the panel and the horizontal-axis end of the panel.

As regards the panel peripheral part, the radius of curvature in a direction parallel to the minor axis was measured with respect to X coordinates=160, 180 and 203. As shown in FIG. 17, the radius of curvature at the panel peripheral part is set so as to have neither a maximum value nor a minimum value, and to monotone-increase away from the major axis (Y=0).

Even in the case where the depression amount gradually increases, if the radius of curvature has a maximum value at an intermediate part, a distortion would occur as indicated by 25 in FIG. 5. In this case, the pincushion-type distortion is easier to correct with the curved surface.

(Comparative Example)

There is provided a color cathode-ray tube wherein the shape of the inner surface of the panel meets the relationships, $$(Z_{PD}-Z_{PH})/L_{PS}=0.021, \text{ and } Z_{PD}/L_{PD}=0.039, \text{ and}$$

the mask body meets the relationships, $$(Z_{MD}-Z_{MH})/L_{MS}=0.007, \text{ and } Z_{MD}/L_{MD}=0.062.$$

According to this color cathode-ray tube, the peripheral luminance can be kept at a good level. However, the anti-pressure strength of the mask body is 60 Pa and is insufficient. Consequently, degradation in display quality, such as degradation in color purity, is conspicuous.

According to the color cathode-ray tube with the above-described structure, the image distortion on the screen can completely be corrected by the magnetic fields that are generated by the magnets disposed on the deflection yoke. In addition, since the radius of curvature of the mask body is set at a proper condition, the mechanical strength of the mask body can be improved, and deformation of the mask body in the fabrication process or due to external shock can be prevented. Thereby, deterioration in color purity due to displacement in beam landing, which results from deformation of the mask body, can be suppressed.

Furthermore, while distortion-free images can be displayed, the curvatures of the mask body and the inner surface of the panel are set at proper conditions. Thus, uniform luminance can be obtained over the entire screen, and a high-quality image can be displayed. Besides, degradation in flatness can be prevented and the visibility can be enhanced.

The present invention is not limited to the above-described embodiments. At the stage of practicing the invention, various modifications and alterations may be made without departing from the spirit of the invention. The embodiments may properly be combined and practiced, if possible. In this case, advantages are obtained by the combinations. For example, the present invention is applicable not only to a color cathode-ray tube with an aspect ratio of 4:3, but also to a color cathode-ray tube with an aspect ratio of 16:9.

As has been described above, the present invention can provide a color cathode-ray tube with good visibility, which can have uniform luminance over the entire screen and can display high-quality images with less distortion.

What is claimed is:

1. A color cathode-ray tube comprising:

an envelope including a substantially rectangular panel with a substantially flat outer surface, and a funnel coupled to the panel;

a phosphor screen that is formed on an inner surface of the panel;

an electron gun assembly that is disposed within the envelope and configured to emit an electron beam toward the phosphor screen;

a shadow mask including a mask body that is disposed to face the phosphor screen and has a number of electron beam passage holes, and a mask frame that supports a peripheral part of the mask body; and a deflection yoke configured to generate a deflection magnetic field that deflects the electron beam emitted from the electron gun assembly, wherein the envelope has a tube axis that passes through a central part of the panel and a center of the electron gun assembly, a horizontal axis that intersects at right angles with the tube axis, and a vertical axis that intersects at right angles with the tube axis and the horizontal axis, at least a pair of magnets are disposed on a horizontal axis of that part of the deflection yoke, which is located on the phosphor screen side, and the mask body satisfies the following conditions, $$(Z_{MD}-Z_{MH})/L_{MS} \geqq 0.020, \text{ and}$$

$$0.065 \leqq Z_{MD}/L_{MD} \leqq 0.095$$

where in a substantially rectangular effective region with a predetermined curvature of the mask body, $L_{MD}$ is a distance between a central part and a diagonal-axis end of the effective region, $L_{MS}$ is a distance between a horizontal-axis end and the diagonal-axis end of the effective region, $Z_{MD}$ is a height difference between the central part and the diagonal-axis end in a direction of the tube axis, and $Z_{MH}$ is a height difference between the central part and the horizontal-axis end in the direction of the tube axis.

2. A color cathode-ray tube comprising:

an envelope including a panel with a substantially flat outer surface and a substantially rectangular effective portion, and a funnel coupled to the panel;

a phosphor screen that is formed on an inner surface of the panel;

an electron gun assembly that is disposed within the envelope and configured to emit an electron beam toward the phosphor screen;

a shadow mask including a mask body that is disposed to face the phosphor screen and has a number of electron beam passage holes, and a mask frame that supports a peripheral part of the mask body; and a deflection yoke configured to generate a deflection magnetic field that deflects the electron beam emitted from the electron gun assembly, wherein the envelope has a tube axis that passes through a central part of the panel and a center of the electron gun assembly, a horizontal axis that intersects at right angles with the tube axis, and a vertical axis that intersects at right angles with the tube axis and the horizontal axis, at least a pair of magnets are disposed on a horizontal axis of that part of the deflection yoke, which is located on the phosphor screen side, and the effective portion of the panel satisfies the following conditions, $$(Z_{PD}-Z_{PH})/L_{PS} \geqq 0.030, \text{ and}$$

$$0.045 \leqq Z_{PD}/L_{PD} \leqq 0.075$$

where in a substantially rectangular inner surface with a predetermined curvature of the effective portion of the panel, $L_{PD}$ is a distance between a central part and a diagonal-axis end of the inner surface of the effective portion, $L_{PS}$ is a distance between a horizontal-axis end and the diagonal-axis end of the inner surface of the effective portion, $Z_{PD}$ is a height difference between the central part and the diagonal-axis end in a direction of the tube axis, and $Z_{PH}$ is a height difference between the central part and the horizontal-axis end in the direction of the tube axis.

3. A color cathode-ray tube comprising:

an envelope including a panel with a substantially flat outer surface and a substantially rectangular effective portion, and a funnel coupled to the panel;

a phosphor screen that is formed on an inner surface of the panel;

an electron gun assembly that is disposed within the envelope and configured to emit an electron beam toward the phosphor screen;

a shadow mask including a mask body that is disposed to face the phosphor screen and has a number of electron beam passage holes, and a mask frame that supports a peripheral part of the mask body; and a deflection yoke configured to generate a deflection magnetic field that deflects the electron beam emitted from the electron gun assembly, wherein the envelope has a tube axis that passes through a central part of the panel and a center of the electron gun assembly, a horizontal axis that intersects at right angles with the tube axis, and a vertical axis that intersects at right angles with the tube axis and the horizontal axis, at least a pair of magnets are disposed on a horizontal axis of that part of the deflection yoke, which is located on the phosphor screen side, the effective portion of the panel satisfies the following conditions, $$(Z_{PD}-Z_{PH})/L_{PS} \geqq 0.030, \text{ and}$$

$$0.045 \leqq Z_{PD}/L_{PD} \leqq 0.075$$

where in a substantially rectangular inner surface with a predetermined curvature of the effective portion of the panel, $L_{PD}$ is a distance between a central part and a diagonal-axis end of the inner surface of the effective portion, $L_{PS}$ is a distance between a horizontal-axis end and the diagonal-axis end of the inner surface of the effective portion, $Z_{PD}$ is a height difference between the central part and the diagonal-axis end in a direction of the tube axis, $Z_{PH}$ is a height difference between the central part and the horizontal-axis end in the direction of the tube axis, and the mask body satisfies the following conditions, $$(Z_{MD}-Z_{MH})/L_{MS} \geqq 0.020, \text{ and}$$

$$0.065 \leqq Z_{MD}/L_{MD} \leqq 0.095$$

where in a substantially rectangular effective region with a predetermined curvature of the mask body, $L_{MD}$ is a distance between a central part and a diagonal-axis end of the effective region, $L_{MS}$ is a distance between a horizontal-axis end and the diagonal-axis end of the effective region, $Z_{MD}$ is a height difference between the central part and the diagonal-axis end in a direction of the tube axis, and $Z_{MH}$ is a height difference between the central part and the horizontal-axis end in the direction of the tube axis.

4. The color cathode-ray tube according to claim 2, wherein in a horizontal-axis-end-side part of the panel, which corresponds to at least a ⅓ of a range between the central part of the panel and the horizontal-axis end, a radius of curvature to the inner surface of the panel is set such that the radius of curvature has neither a maximum value nor a minimum value and monotone-increases away from the horizontal axis.

5. The color cathode-ray tube according to claim 2, wherein the central part of the effective portion of the panel has a light transmittance of glass of 45% to 55% at a wavelength of 546 nm.

* * * * *